United States Patent [19]

Yamaguchi et al.

[11] 4,368,442

[45] Jan. 11, 1983

[54] MERCURY SWITCH

[75] Inventors: Kohmei Yamaguchi, Yokohama; Kazuo Kobayashi; Takeo Furukawa, both of Suzaka, all of Japan

[73] Assignee: Fujitsu Limited, Kawasaki, Japan

[21] Appl. No.: 214,206

[22] Filed: Dec. 8, 1980

[30] Foreign Application Priority Data

Dec. 11, 1979 [JP] Japan ..... 54-170417[U]

[51] Int. Cl.[3] ..... H01H 29/04

[52] U.S. Cl. ..... 335/57; 335/58; 29/622

[58] Field of Search ..... 335/51, 49, 55, 57, 335/58; 29/622

[56] References Cited

U.S. PATENT DOCUMENTS

| | | | |
|---|---|---|---|
| 3,331,037 | 7/1967 | Hempel | 335/58 |
| 4,066,859 | 1/1978 | Steinmetz | 335/58 |
| 4,164,720 | 8/1979 | Bollen | 335/58 |

*Primary Examiner*—George Harris

*Attorney, Agent, or Firm*—Staas & Halsey

[57] ABSTRACT

A mercury switch in which a magnetic armature and a magnetic pole having a fixed contact are inserted in a glass tube, mercury is introduced into the glass tube to wet the contact point, and both ends of the glass tube are sealed. A recessed portion is formed in a portion of the magnetic pole and the fixed contact is adhered into the recessed portion. A film of a metal oxide which will be only slightly wetted with mercury is formed on the surface of the magnetic pole except on the surface of the fixed contact.

11 Claims, 11 Drawing Figures

MERCURY SWITCH

FIELD OF THE INVENTION

The present invention relates to a mercury switch, and more specifically to an improvement in a fixed contact employed in a mercury switch.

BACKGROUND OF THE INVENTION

A mercury switch has heretofore been used to make or break the electric circuit by a contact in which the surface is wetted with mercury. Mercury permits the conduction of electricity at a contact point in the mercury switch. Accordingly, the mercury switch exhibits very small contact resistance and increased stability. The fixed contact of the mercury switch is usually formed through the steps mentioned below. Namely, an oblong contact material is welded onto the flat surface of a magnetic pole which supports the fixed contact point. Then, the contact material is formed in the shape of a contact point by press working, followed by chromium plating over all the surfaces. Thereafter, chromium on the contact surface of the contact point is removed by polishing by electric discharge. Finally, the remainder of chromium is oxidized to form chromium oxide on the surfaces other than the contact surface. Therefore, the contact surface can be easily wetted with mercury, but other portions are not easily wetted with mercury.

The fixed contact can also be formed by the following method. That is, the flat magnetic pole is plated with chromium throughout all the surfaces, and a granular contact material is welded onto the magnetic pole.

The contact point prepared by the former method features a small contact area. However, since the former method polishes the contact surface by using an electric discharge, the manufacturing cost becomes expensive, which inhibits mass-production.

With the latter method, the step for polishing the contact point can be eliminated. However, since the magnetic pole tends to be wetted with mercury up to the side surface of the contact point, mercury tends to adhere in large amounts to the contact point. Such a large amount of mercury tends to easily come into contact with an armature which is a moving contact. Further, once contacted, the moving contact can not easily be separated away from mercury. To obtain a smooth contact operation, thereore, it is necessary to increase the gap between the contact points. However, the increased gap decreases the sensitivity when the mercury switch is adapted to the relays.

SUMMARY OF THE INVENTION

The present invention is to improve the above-mentioned defects.

For this purpose, the gist of the present invention resides in a mercury switch in which a magnetic armature and a magnetic pole having a fixed contact are inserted in a glass tube, mercury is introduced into the glass tube to wet the contact point, and both ends of the glass tube are sealed, the improvement wherein a recessed portion is formed in a portion of the magnetic pole, a contact material is adhered into the recessed portion, and a film of metal oxide which will be poorly (or preferably never) wetted with mercury is formed on the surface of the magnetic pole without forming the film on the surface of the fixed contact.

DESCRIPTION OF THE PREFERRED EMBODIMENTS

Figure 1:
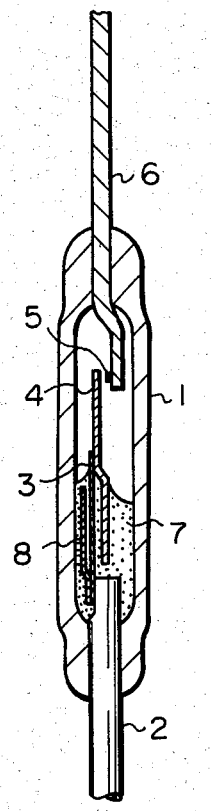
FIGS. 1 and 2 are cross-sectional views of mercury switches according to different embodiments of the present invention.
Figure 2:
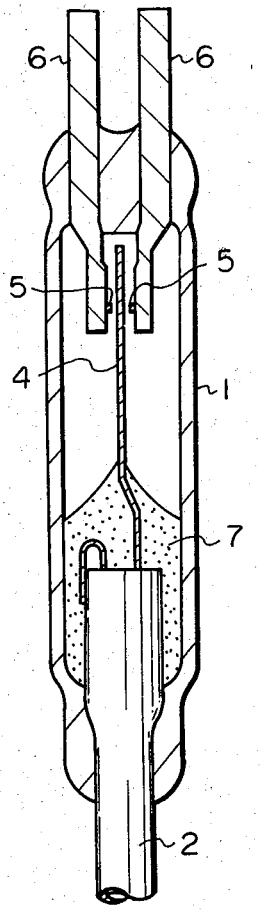

The contact construction according to the present invention can be adapted to a mercury switch of the type shown, for example, in FIG. 1 or FIG. 2. FIG. 1 illustrates the mercury switch of the one-make type in which one armature corresponds to one magnetic pole.

As shown in FIG. 1, the mercury switch comprises a glass tube 1, a ferromagnetic tube 2 which seals the lower portion of the glass tube 1 and which works to make an electric connection and a magnetic connection to the external unit as well as to introduce mercury, and an armature 4 fitted to the ferromagnetic tube 2 via a spring 3 made of stainless steel. In the upper side of the glass tube 1 is also provided a magnetic pole 6 which enables the electric connection and the magnetic connection to be made and which has a fixed contact 5 at the tip thereof. The lower portion of the glass tube 1 forms a mercury reservoir where mercury 7 is contained. The mercury 7 rises along the surface of the armature 4 due to capillarity, and is supplied to the contact point. The tube 2 is crushed at its lower portion which is not shown, and is closed. The interior of the glass tube 1 is hermetically sealed. It is desirable to fill a reducing hydrogen gas in the glass tube 1. Many vertically running grooves (not shown) are formed in the surfaces on both sides of the armature 4 so that the mercury can be sucked up by capillarity. Reference numeral 8 denotes an auxiliary plate which works as a stopper when the contact is opened and the armature 4 separates away from the fixed contact 5; the auxiliary plate 8 prevents the armature 4 from coming into contact with the glass tube 1. A coil (not shown) is formed around the glass tube 1 of the mercury switch. When a magnetic field is established by the electric current, which flows into the coil, the armature 4 is attracted toward the magnetic pole 6 and comes into contact with the fixed contact 5.

FIG. 2 is a cross-sectional view of the mercury switch of the one-transfer type which has fixed contacts on both sides of the armature 4.

Figure 5:
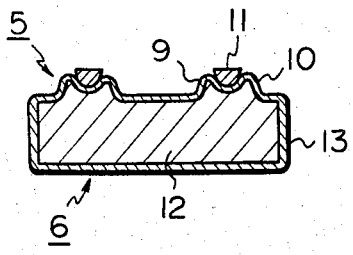
FIG. 5 is a cross-sectional view of the fixed contact of FIG. 4.

FIG. 5 is a cross-sectional view illustrating a portion of the fixed contact 5, in which reference numeral 12 denotes a main body of a magnetic pole, 13 denotes the chromium plated surface of the magnetic pole, and 11 denotes a contact material. A small protuberance 9 having a small recess 10 is formed on the magnetic pole 6. After the pole 6 is plated with chromium, the contact material 11 of the shape of a granule is welded into the small recess 10. Then, the mercury switch is assembled in accordance with the customary steps.

Figure 3:
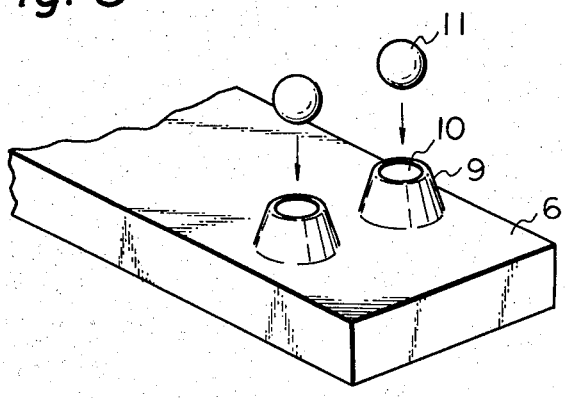
FIG. 3 is a view illustrating the construction of a fixed contact according to the present invention before it is assembled.
Figure 4:
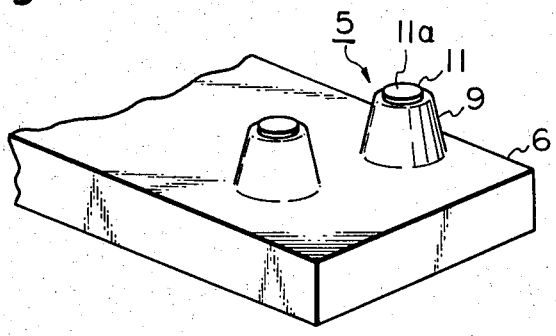
FIG. 4 is a perspective view of the fixed contact of FIG. 3 after it is assembled.

The main body 12 of the magnetic pole is made of a nickel alloy consisting of, for example, 52% of nickel and 48% of iron. The armature 4 (refer to FIGS. 1 and 2) is also made of the same nickel alloy. The contact material 11 will be made of an alloy composed of 85% of platinum and 15% of nickel, or a nickel-copper alloy. The contact material 11 is, first, formed in the shape of a granule (having nearly a spherical shape) as shown in FIG. 3. Chromium is plated on the portions of the magnetic pole 6 inserted in the glass tube 1 (FIG. 1) covering surfaces of the small protuberance 9 (FIG. 3) and inner surfaces of the small recess 10 (FIG. 3) in the protuberance before the contact material is welded thereto. The granular contact material 11 is placed in the small recess 10 of the protuberance 9 of the chromium-plated magnetic pole 6 as indicated by an arrow in FIG. 3, and is welded thereto by the electric resistance welding method. During the welding, the contact material 11 is pressed by the electrode (not shown) of a welding machine. After being welded, the upper surface 11*a* of the contact material 11 becomes flat (see FIG. 4), and most of the side portions are buried in the recess 10 (see FIGS. 4 and 5). The magnetic pole 6 having the electrically conductive fixed contact 5 which is formed as mentioned above, is then subjected to the oxidation treatment so that a film of chromium oxide is formed on the pole. The chromium oxide is not formed on the surface of the contact material 11 because chromium is not plated thereon. The film of chromium oxide has a poor property to be wetted with mercury, i.e. it hardly catches mercury. Therefore, when the mercury switch is assembled, the mercury does not adhere onto the magnetic pole 6 but adheres onto the contact material only. When the chromium is to be oxidized, the exposed surface of the contact material 11 is also oxidized. The exposed surface of the contact material 11, however, is reduced in a subsequent step of glass annealing with a high-temperature hydrogen gas simultaneously with the annealing of the glass. Here, the chromium oxide which is a stable compound is not reduced.

To form the above-mentioned fixed contact, a recess is formed in the magnetic pole, chromium is plated on all the surfaces of the magnetic pole, the contact material is welded onto the recess, and then the chromium is oxidized. Accordingly, chromium oxide is not formed on the surface of the contact material, and no step is required to remove chromium oxide from the contact surface unlike the conventional art. By making the recess a suitable size, the contact surface only of the contact point can be exposed to form a flat surface; almost the entire surface of the peripheral side surfaces of the contact point can be buried in the recess. Accordingly, mercury adheres onto the contact surface only to maintain a good electrical connection; mercury adheres onto the side surfaces of the contact point in negligibly small amounts. Since there is no excess of mercury in the periphery of the contact point, the fixed contact and the moving contact do not come into contact with each other so easily. Consequently, the contact gap can be reduced to make a small mercury switch.

Figure 6:
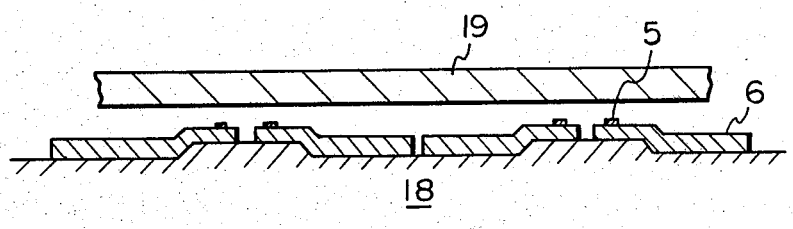
FIG. 6 is a view illustrating the conventional method of polishing the contact of a magnetic pole employed in the mercury switch of FIG. 2.

Elimination of the step for removing the film of chromium oxide from the surface of the contact material in accordance with the present invention, presents particularly great advantage for producing the one-make-type mercury switch shown in FIG. 1. The reasons will be discussed below. In the one-make-type mercury switch, it is desirable to dispose the magnetic pole along the center line of the glass tube so that the glass tube will not crack at the sealing portion. Therefore, the fixed contact 5 is fixed to a recessed portion at the tip of the magnetic pole as shown in FIG. 1. Referring to the one-transfer-type mercury switch, on the other hand, the two magnetic poles 6 are symmetrically disposed relative to the center line of the glass tube, and, hence, the fixed contacts 5 are attached to the protruded tips of the magnetic poles. The electric discharge polishing is best suited for removing the chromium oxide from a very small member (having a width of about 1 mm) such as a magnetic pole. When the magnetic poles of the one-transfer-type mercury switch are to be polished by the electric discharge, they are arrayed in parallel on a base plate 18, and electrodes 19 are disposed above them as illustrated in FIG. 6. In this case, since the fixed contact 5 is closest to the electrode 19, the fixed contact 5 only is polished by the electric discharge which is generally effected from above the magnetic poles 6. Therefore, large plate-like electrodes 19 can be employed. When a portion corresponding to the fixed contact 5 is worn out, the position of the electrode 19 should be slightly shifted.

Figure 7:
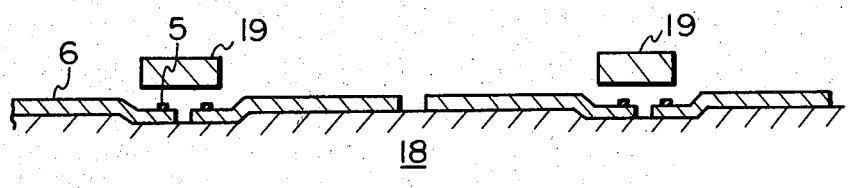
FIG. 7 is a diagram illustrating the conventional method of polishing the contact of a magnetic pole employed in the mercury switch of FIG. 1.

When the fixed contact of the one-make-type mercury switch is to be polished by the electric discharge, the electrode 19 must be divided since the fixed contact 5 is located at a lower position as shown in FIG. 7. Further, the electrode 19 must be renewed when it is worn out.

As mentioned above, the polishing by electric discharge involves a clumsy operation. In particular, laborious work is required when the fixed contact of the one-make-type mercury switch is to be polished by the electric discharge since the electrode must be replaced frequently.

Consequently, the present invention which eliminates the cumbersome step of polishing by using an electric discharge, presents a great advantage particularly for the manufacture of one-make-type mercury switches.

Figure 8:
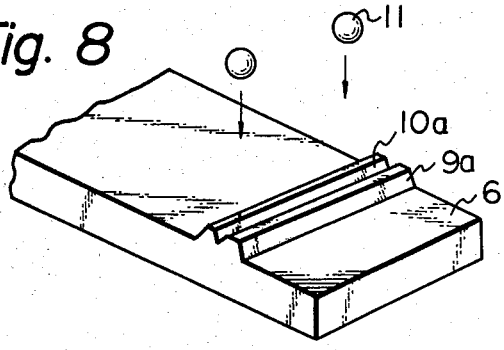
FIG. 8 is a view illustrating the construction of the fixed contact before it is assembled, according to a further embodiment of the present invention.
Figure 9:
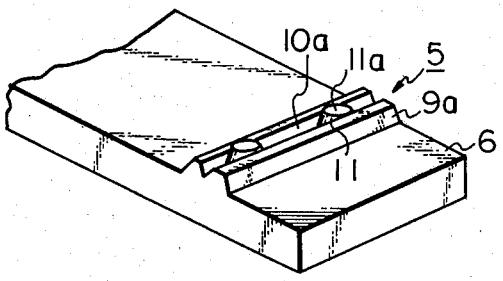
FIG. 9 is a perspective view of the fixed contact of FIG. 8 after it is assembled.

FIGS. 8 and 9 illustrate a fixed contact of the mercury switch according to another embodiment of the present invention, in which a protuberance 9*a* having a groove 10*a* traverses the magnetic pole 6. The magnetic pole 6 is plated with chromium over all the surfaces like the above-mentioned embodiment, and the contact material 11 is fitted into the groove 10*a* by electric resistance welding. Other setups, functions and effects are the same as those of the aforementioned embodiment.

Figure 10:
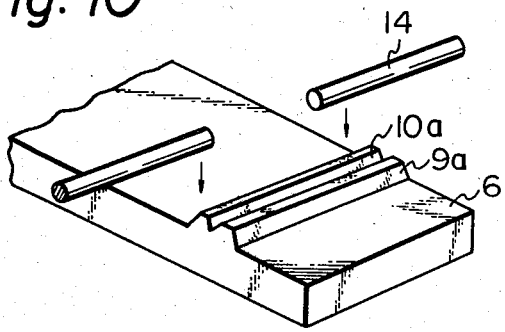
FIG. 10 is a diagram illustrating the construction of the fixed contact before it is assembled, according to still another embodiment of the present invention.
Figure 11:
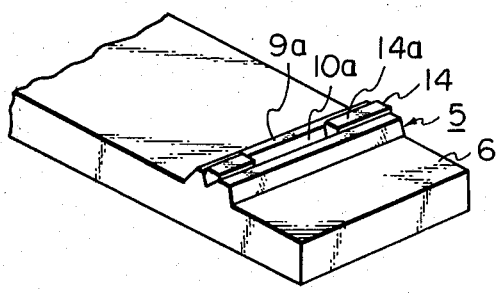
FIG. 11 is a perspective view of the fixed contact of FIG. 10 after it is assembled.

FIGS. 10 and 11 illustrate a fixed contact according to still another embodiment of the present invention. According to this embodiment, a cylindrical or rod-like material 14 (FIG. 10) is used as the contact material. The contact material 14 is welded into the groove 10*a*, and is then cut along the side edge of the magnetic pole (FIG. 11). Similar to the above-noted embodiments, the contact material 14 is then formed with a flat upper surface 14*a*, as shown in FIG. 11.

Figure 12:
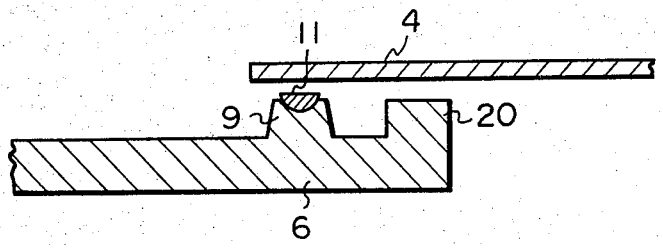
FIG. 12 is a cross-sectional view of the fixed contact according to yet a further embodiment of the present invention.

In yet another embodiment of the present invention, an enlarged portion 20 may be formed at the tip of the magnetic pole 6 as shown in FIG. 12. When the magnetic field is established in the switch, the enlarged portion 20 produces an increased magnetic force for attracting the armature 4, and makes it possible to realize a switch of high sensitivity.

We claim:

1. A mercury switch in which a magnetic armature and a magnetic pole having a fixed contact are inserted in a glass tube, mercury is introduced into the glass tube to wet the contact point, and both ends of the glass tube are sealed, the improvement wherein a recessed portion is formed in a portion of the magnetic pole, a contact material is adhered into the recessed portion to form a fixed contact having an upper exposed contact surface and side portions substantially buried in said recessed portion, and a film of metal oxide which will be poorly wetted with mercury is formed on the surface of the magnetic pole except on the surface of the fixed contact.

2. A mercury switch according to claim 1, wherein a protuberance is formed on the magnetic pole, and the recessed portion is formed in said protuberance.

3. A mercury switch according to claim 2, wherein said protuberance is nearly of a conical shape having a recessed portion in the tip portion thereof for receiving said contact material.

4. A mercury switch according to claim 2, wherein said protuberance is continuously formed to traverse the magnetic pole, and has a groove that is formed in the upper side thereof for receiving said contact material.

5. A mercury switch according to claim 1, 2, 3, or 4, wherein an enlarged portion is provided at the tip of the magnetic pole to increase its sensitivity with respect to the magnetic field.

6. In a method of producing a mercury switch in which a magnetic armature and a magnetic pole having a fixed contact are inserted in a glass tube, mercury is introduced into the glass tube to wet the contact point, and both ends of the glass tube are sealed, the improvement wherein the method includes the steps of forming a recessed portion in a portion of the magnetic pole, forming a metal film on the surface of the magnetic pole, and after the step of forming the metal film, adhering said fixed contact into said recessed portion with the side portions being substantially buried in said recessed portion, and subjecting said metal film to oxidation in order to form a film of metal oxide which has a poor property of being wetted with mercury only on said magnetic pole.

7. A method of producing a mercury switch according to claim 6, comprising, in attaching said fixed contact, the step of depressing the upper portion of said fixed contact so that a flat upper exposed contact surface is formed.

8. A method of producing a mercury switch according to claim 6 or 7, wherein a protuberance of nearly a conical shape having a recessed portion in the top portion thereof, is formed in the magnetic pole, a granular contact material is placed in said recessed portion, and said granular contact material is adhered thereto by welding.

9. A method of producing a mercury switch according to claim 6 or 7, wherein a protuberance having a groove-like recessed portion is formed in the magnetic pole in a traversing manner, a rod-like contact material is placed in said recessed portion, and said rod-like contact material is welded thereto and cut along the side edge of the magnetic pole.

10. The mercury switch of claim 1, comprising a one-make type mercury switch having a single magnetic pole bent inwardly at the portion on which said fixed contact is located.

11. The method of claim 6 comprising producing a one-make type mercury switch having a single magnetic pole bent inwardly at one portion and wherein the recessed portion is formed in said inwardly bent portion of the magnetic pole.

* * * * *